US007809307B2

(12) United States Patent
Fukumoto et al.

(10) Patent No.: US 7,809,307 B2
(45) Date of Patent: Oct. 5, 2010

(54) IMAGE FORMING APPARATUS WITH CLEANER HAVING MEMBER IN CONTACT WITH A SURFACE OF AN IMAGE CARRIER

(75) Inventors: Kazuko Fukumoto, Ibaraki (JP); Masahiko Matsuura, Suita (JP); Atsuto Hirai, Ikoma (JP); Tetsuya Kobayashi, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 822 days.

(21) Appl. No.: 11/717,927

(22) Filed: Mar. 14, 2007

(65) Prior Publication Data

US 2007/0223980 A1 Sep. 27, 2007

(30) Foreign Application Priority Data

Mar. 22, 2006 (JP) ..... JP2006-078567
Feb. 1, 2007 (JP) ..... JP2007-022786
Feb. 16, 2007 (JP) ..... JP2007-036121

(51) Int. Cl.
*G03G 15/16* (2006.01)
*G03G 21/00* (2006.01)

(52) U.S. Cl. ..... 399/101; 399/249; 399/348

(58) Field of Classification Search ..... 399/101, 399/249, 348
See application file for complete search history.

(56) References Cited

U.S. PATENT DOCUMENTS 6,347,212 B1 2/2002 Kosugi et al.
6,978,111 B2 * 12/2005 Nagata et al. ..... 399/348
7,590,368 B2 * 9/2009 Kamijo et al. ..... 399/101

FOREIGN PATENT DOCUMENTS

JP 2002-082537 3/2002

* cited by examiner

*Primary Examiner*—William J Royer
(74) *Attorney, Agent, or Firm*—Brinks Hofer Gilson & Lione

(57) ABSTRACT

To provide a cleaning apparatus capable of maintaining high cleaning performance even if surface roughness of an image carrier is increased due to wear and a wet image forming apparatus installing the concerned cleaning apparatus, thereby enabling to form images of a stable quality. The cleaning apparatus for removing liquid developer remaining on the surface of a latent image carrier and an intermediate transfer member, which are an image carrier of the image forming apparatus for forming images with the liquid developer including toner particles and carrier liquid, includes three stages of cleaning sections such as a preliminary cleaning member for making contact with the image carrier and suspending the toner particles adhered to the surface of the image carrier in the carrier liquid, a toner particles removing member for removing the suspended toner particles by electrostatic force, and a carrier liquid removing member for removing the remaining carrier liquid.

22 Claims, 5 Drawing Sheets

IMAGE FORMING APPARATUS WITH CLEANER HAVING MEMBER IN CONTACT WITH A SURFACE OF AN IMAGE CARRIER

This application is based on the Japanese Patent Application No. 2006-078567 filed on Mar. 22, 2006, No. 2007-022786 filed on Feb. 1, 2007, and No. 2007-036121 filed on Feb. 16, 2007, in Japanese Patent Office, the entire content of which is hereby incorporated by reference.

TECHNICAL FIELD

The present invention relates to a cleaning apparatus, an image forming apparatus comprising the cleaning apparatus, and a cleaning method.

BACKGROUND

A printer is conventionally used mainly as a means for preparing a large quantity of prints at high speed. As a matter of fact, in the printing field where printing plates must be prepared every time even small quantity orders are placed, the printing business becomes unprofitable, so it has required a printing technology called an on-demand printing system that can respond to such small quantity orders.

And, as an image forming technique for providing a small quantity of prints at high speed and low price, image formation by an electrophotographic system is noticed. Among image forming apparatuses of an electrophotographic system, a wet image forming apparatus using a liquid developer with toner particles dispersed in an insulating carrier liquid has advantages which cannot be realized by a dry image forming apparatus, and in recent years the value thereof has been reviewed. The main advantages of the wet image forming apparatus are to be able to use very fine toner particles, thereby realizing a high image quality, and obtain a quality feeling like print and to be able to fix toner on sheets of paper at a comparatively low temperature, thereby realizing energy conservation. Particularly, in recent years, in correspondence with increasing demands for high image quality, the average diameter of toner particles used is apt to be made smaller and smaller.

As a wet image forming apparatus, conventionally, an image forming apparatus for developing an electrostatic latent image on the surface of a latent image carrier with a liquid developer including toner particles and a carrier liquid, transferring a toner image formed by development on the surface of the latent image carrier to an image receiving material, thereby obtaining a final image is known. Further, an image forming apparatus for transferring primarily the toner image developed by the liquid developer on the surface of the latent image carrier to an intermediate transfer member, furthermore transferring secondarily the toner image transferred to the surface of the intermediate transfer member to an image receiving material, thereby obtaining a final image is known.

In such an image forming apparatus, a cleaning apparatus, after image formation, for removing a liquid developer remaining on the surfaces of the latent image carrier, which is an image carrier, and the intermediate transfer member is installed. In the cleaning apparatus, conventionally, a cleaning blade similar to that of the dry image forming apparatus is used generally. However, when the average diameter of toner particles used is made smaller and becomes comparable in size to the ten-point average roughness Rz (JIS B 0633:2001) of the surface of the image carrier, toner particles thrust into concavities and pass through the cleaning blade, thus a problem arises that toner particles cannot be removed sufficiently. Particularly, if Rz of the image carrier is increased due to repetition of image output, passing of toner particles through the cleaning blade becomes remarkable and it is hard to sufficiently remove toner particles. When removal of the liquid developer is insufficient like this, in the next output image, a defective image quality such as gray background occurs, thus resulting in a problem.

With the foregoing problem in view, a cleaning apparatus having a cleaning roller made of an elastic member installed in front of a cleaning blade is proposed (for example, refer to Laid-Open Japanese Patent Application Publication No. 2002-82537). This device rotates the cleaning roller made of an elastic member by pressurizing it to an image carrier, suspends toner adhered to the surface of the image carrier in a carrier liquid, and then removes the toner by the cleaning blade, so that compared with a cleaning apparatus having only a cleaning blade, the device improves the removing rate of liquid developer.

However, even if the aforementioned measure is taken, the following problem remains unsettled.

Toner particles entering fine concavities of the surfaces of the latent image carrier which is the image carrier and intermediate transfer member can be suspended once in the carrier liquid by the cleaning roller made of an elastic member, though when removing the toner particles by the cleaning blade, they enter again the concavities, so that the problem remains unsettled still that toner particles pass through the cleaning blade. Particularly, when the surface of the image carrier becomes rough due to wear and toner particles are apt to enter it, it is difficult to remove sufficiently toner particles.

SUMMARY

The present invention was developed with the foregoing technical problem in view and is intended to provide a cleaning apparatus, an image forming apparatus and a cleaning method for sufficiently removing a liquid developer remaining on the surface of the image carrier and to provide an image forming apparatus capable of forming images of a stable quality by installation of the concerned cleaning apparatus. In view of foregoing, one embodiment according to one aspect of the present invention is a cleaning apparatus for an image forming apparatus which forms an image with liquid developer containing toner particles and carrier liquid, the cleaning apparatus comprising:

a preliminary cleaning member which contacts with a surface of an image carrier to suspend the toner particles in the carrier liquid on the image carrier;

a toner particles removing member which is provided downstream of the preliminary cleaning member in a moving direction of the image carrier and removes the suspended toner particles in the carrier liquid by an electrostatic force; and a carrier liquid removing member which is provided downstream of the toner particles removing member in the moving direction of the image carrier and removes the carrier liquid.

According to another aspect of the present invention, another embodiment is an image forming apparatus, comprising:

an image carrier;

an image forming mechanism which is adapted to form an electrostatic latent image on the image carrier;

a development mechanism which is adapted to develop the electrostatic latent image formed on the image carrier into a toner image with a liquid developer containing the toner particles and the carrier liquid;

a transfer mechanism which is adapted to transfer the toner image formed on the image carrier onto an image receiving material; and a cleaning apparatus as mentioned above for cleaning the liquid developer remaining on the image carrier after the transferring of the transfer mechanism.

According to another aspect of the present invention, another embodiment is an image forming apparatus, comprising:

an image carrier;

an image forming mechanism which is adapted to form an electrostatic latent image on the image carrier;

a development mechanism which is adapted to develop the electrostatic latent image formed on the image carrier into a toner image with a liquid developer containing the toner particles and the carrier liquid;

an intermediate transfer member;

a primary transfer mechanism which is adapted to transfer the toner image formed on the image carrier onto an intermediate transfer member;

a secondary transfer mechanism which is adapted to transfer the toner image transferred on the intermediate transfer member onto the image receiving material; and a cleaning apparatus for cleaning the liquid developer remaining on the intermediate transfer member after the transferring of the secondary transfer mechanism; the cleaning apparatus comprising:

a preliminary cleaning member which contacts with a surface of the intermediate transfer member to suspend the toner particles in the carrier liquid on the intermediate transfer member;

a toner particles removing member which is provided downstream of the preliminary cleaning member in a moving direction of the intermediate transfer member and removes the suspended toner particles in the carrier liquid by an electrostatic force; and a carrier liquid removing member which is provided downstream of the toner particles removing member in the moving direction of the intermediate transfer member and removes the carrier liquid.

According to another aspect of the present invention, another embodiment is a cleaning method for an image forming apparatus which forms an image by using a liquid developer containing toner particles and carrier liquid, the method comprising:

suspending the toner particles in the carrier liquid by making a preliminary cleaning member contact with an image carrier;

removing the toner particles in the carrier liquid suspended by the preliminary cleaning member by an electrostatic force; and removing the carrier liquid remaining on the image carrier after removing the toner particles.

DETAILED DESCRIPTION OF THE PREFERRED EMBODIMENTS

Hereinafter, the embodiments of the present invention will be explained with reference to the accompanying drawings. While the preferred embodiments of the present invention have been described using specific terms, such description is for illustrative purpose only, and it is to be understood that changes and variations may be made without departing from the spirit or scope of the appended claims.

Figure 1:
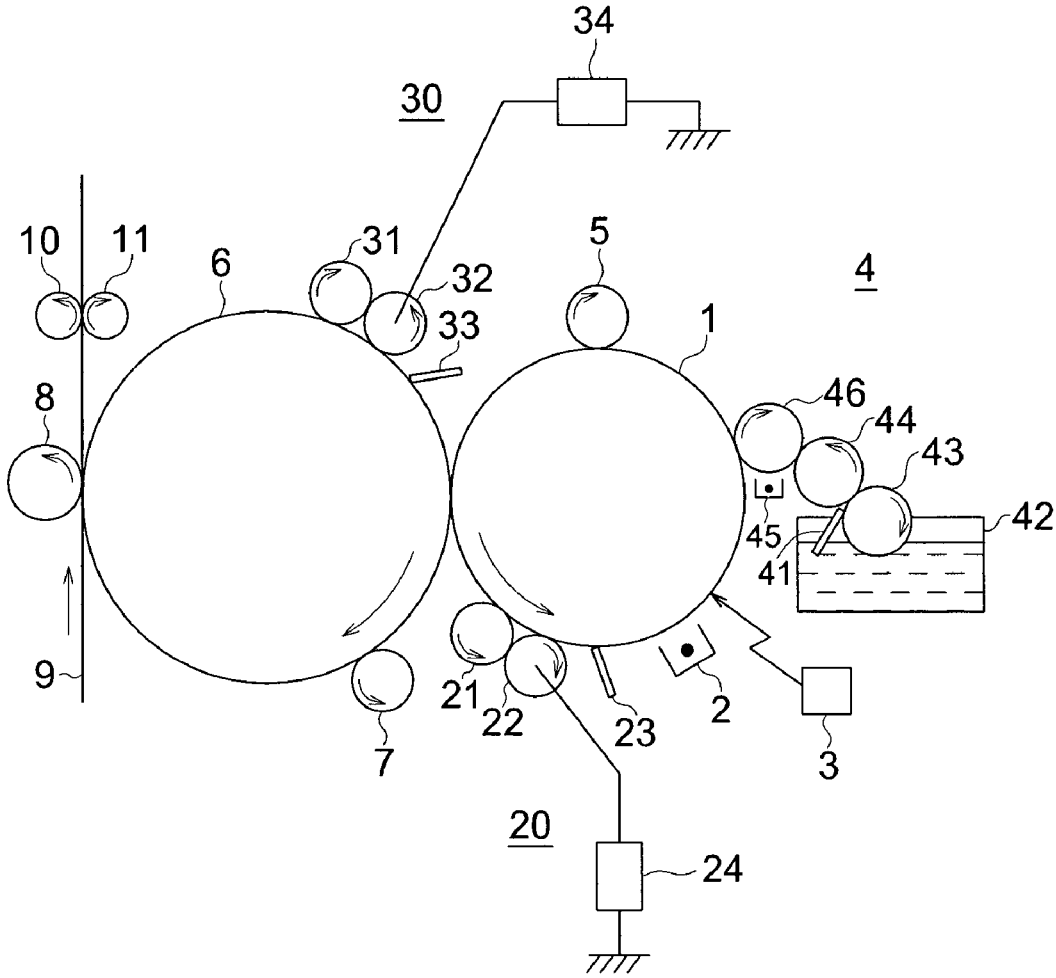
FIG. 1 is a schematic block diagram of an image forming apparatus having a cleaning apparatus of an embodiment of the present invention.

FIG. 1 is a drawing showing the schematic constitution of the cleaning apparatus of an embodiment of the present invention and the image forming apparatus having the cleaning apparatus. Around a drum-shaped latent image carrier 1, sequentially in the rotational direction indicated by the arrow, a main charger 2, an exposure unit 3, a developing unit 4, a latent image carrier squeeze roller 5, an intermediate transfer member 6, and a latent image carrier cleaning apparatus 20 are arranged and around the intermediate transfer member 6, sequentially in the rotational direction indicated by the arrow, an intermediate transfer member squeeze roller 7, a secondary transfer roller 8 as a secondary transfer mechanism, and an intermediate transfer member cleaning apparatus 30 are arranged. The latent image carrier 1 and intermediate transfer member 6 are equivalent to the image carrier of the present invention, and the intermediate transfer member 6 is equivalent to a primary transfer mechanism of the present invention.

The cleaning apparatus which is an embodiment of the present invention removes a liquid developer remaining on the surfaces of the latent image carrier 1 which is an image carrier and the intermediate transfer member 6. Therefore, the cleaning apparatus can be used as a latent image carrier cleaning apparatus 20 and can be used as an intermediate transfer member cleaning apparatus 30. The cleaning apparatus can be used for both. Here, a case that the cleaning apparatus is used as a latent image carrier cleaning apparatus 20 and as an intermediate transfer member cleaning apparatus 30 will be explained.

The operation of the image forming apparatus shown in FIG. 1 will be explained sequentially. The latent image carrier 1 is rotating in the direction indicated by the arrow. Firstly, the image forming apparatus charges uniformly the surface of the latent image carrier 1 at a predetermined surface potential by the main charger 2, then exposes image information by the exposure unit 3, and forms an electrostatic latent image on the surface of the latent image carrier 1. On the other hand, the developing unit 4 draws up a fixed amount of liquid developer by a supply roller 43 and a control blade 41 from a developer tank 42 storing a liquid developer including toner particles and a carrier liquid, and supplies a fixed amount of liquid developer to a developing roller 46 by a supply roller 44. A predetermined amount of charge is supplied to the toner in the liquid developer supplied to the developing roller 46 by a pre-development charger 45.

The electrostatic latent image on the surface of the latent image carrier 1 is developed by the liquid developer on the surface of the developing roller 46 and a toner image is formed on the surface of the latent image carrier 1. At this time, not only the toner particles but also the carrier liquid are adhered onto the surface of the latent image carrier 1. A part of the carrier liquid adhered to the surface of the latent image carrier 1 is removed by the latent image carrier squeeze roller 5 and then the toner image on the surface of the latent image carrier 1 is transferred primarily to the intermediate transfer member 6 impressed with a predetermined voltage. Furthermore, a surplus carrier liquid adhered to the surface of the intermediate transfer member 6 is removed by the intermediate transfer member squeeze roller 7 and then the toner image on the surface of the intermediate transfer member 6 is transferred secondarily to an image receiving material 9 by the secondary transfer roller 8. Thereafter, the image receiving material 9 with the toner image transferred is fixed by fixing devices 10 and 11, thus image formation is completed. The intermediate transfer member 6 may have a drum shape or a belt shape and the material thereof may be any of NBR (acrylonitrile-butadiene rubber), urethane rubber, and fluororubber. Further, the surface may be coated with a layer of fluorine plastics such as PFA (tetrafluoroethylene-perfluoroalkylvinylether copolymer) or urethane.

When the toner image is transferred to the image receiving material 9 from the intermediate transfer member 6, all of the toners are not transferred but a part of the toners often remains on the surface of the intermediate transfer member 6. Unless the remaining toner is removed sufficiently, a defective image quality such as gray background occurs in the next output image, so that it comes into a problem. Therefore, by the intermediate transfer member cleaning apparatus 30, after an image has been output, the liquid developer remaining on the surface of the intermediate transfer member 6 is removed. The intermediate transfer member cleaning apparatus 30 has three stages of cleaning sections such as a preliminary cleaning roller 31 as a preliminary cleaning member for sliding and rubbing the surface of the intermediate transfer member 6 and suspending the toner particles adhered to the surface of the intermediate transfer member in the carrier liquid, a toner particles removing roller 32 as a toner particles removing member for removing suspended toner particles by electrostatic force, and a blade 33 as a carrier liquid removing member for removing the remaining carrier liquid.

The preliminary cleaning roller 31 slides and rubs the surface of the intermediate transfer member 6, scrapes toner particles adhered to the surface of the intermediate transfer member 6, thereby suspends the toner particles in the carrier liquid remaining on the surface of the intermediate transfer member 6. The preliminary cleaning roller 31 is preferably a sponge roller or a brush roller whose contact surface with the intermediate transfer member 6 is in a sponge shape or a brush shape. When it is a sponge-shaped roller, polyurethane foam such as moltplain or color foam can be used. It is possible to compress the contact surface of the preliminary cleaning roller 31 to the surface of the rotating intermediate transfer member 6, thereby sliding along and rubbing against the surface of the rotating intermediate transfer member 6 or to compress the contact surface of the preliminary cleaning roller 31 by vibrating. As mentioned above, when the preliminary cleaning member is composed of a roller-shaped member and the concerned roller-shaped member is rotated, makes contact with the intermediate transfer member 6, and slides and rubs the surface of the intermediate transfer member 6, the chance of sliding and rubbing by the preliminary cleaning member increases, so that it is very effective. In this case, the preliminary cleaning roller 31 is rotated so as to reverse the moving directions of the contact portions with the intermediate transfer member 6 to each other, thus toner particles adhered to the surface of the intermediate transfer member 6 can be suspended effectively in the carrier liquid. To simplify more the constitution, a fixed brush or a fixed sponge may be used.

Figure 4:
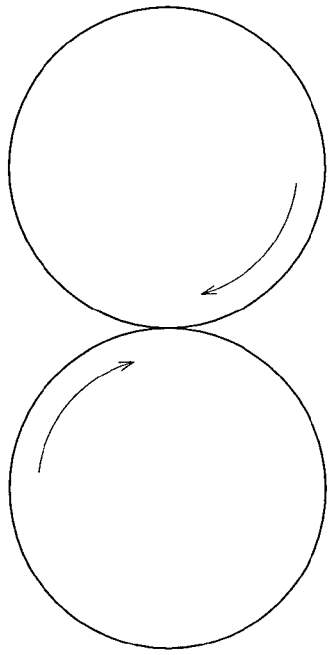
FIG. 4 is an illustration for the rotational directions of the rollers (counter direction).
Figure 5:
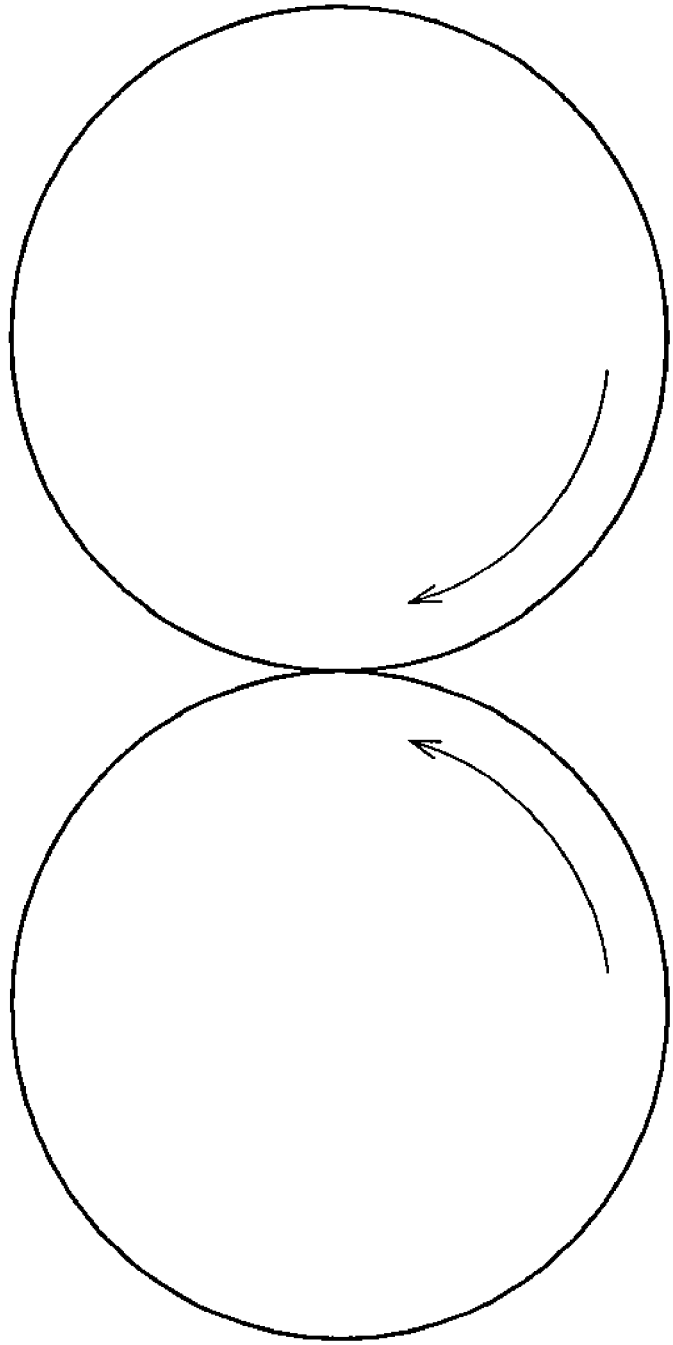
FIG. 5 is an illustration for the rotational directions of the rollers (with direction).

Here, in this specification, when rotating and allowing the two roller members to make contact with each other, rotating the two rollers in the opposite direction (hereinafter, referred to as the counter direction) refers to rotating them in the direction indicated in FIG. 4. In addition, rotating the contact portions in the same direction (hereinafter, referred to as the with direction) refers to rotating them in the direction shown in FIG. 5.

As mentioned above, the preliminary cleaning roller 31 originally slides and rubs the surface of the intermediate transfer member 6, scrapes out toner particles adhered to the surface of the intermediate transfer member 6, thereby suspends the toner particles in the carrier liquid remaining on the surface of the intermediate transfer member 6 and is not intended to remove the toner particles and carrier liquid. However, for example, when using a sponge roller as a preliminary cleaning roller 31, depending on the condition of the sponge roller, the toner particles and carrier liquid may be removed partially. When the removed toner particles are accumulated on the surface of the sponge roller, the original function of the preliminary cleaning member for scraping out the toner particles adhered to the surface of the intermediate transfer member 6 is impaired. Therefore, the preliminary cleaning roller 31 preferably has an exclusive roller or blade, as an additional toner particles removing member, for removing toner particles adhered to the surface. Further, in place of installation of the exclusive roller or blade, it is very effective to structure the toner particles removing roller 32 so as to remove toner particles on the surface of the preliminary cleaning roller 31 by electrostatic force. By use of this constitution, due to removing by the electrostatic force, the removing efficiency of toner particles is high and there is an advantage that the removing member such as an exclusive roller or blade is not necessary. The preliminary cleaning roller 31 and toner particles removing roller 32 preferably make contact with each other by rotating and in this case, it is effective that the moving directions of the contact portions are the with directions.

Further, when a cleaning liquid supply mechanism for supplying a cleaning liquid to the preliminary cleaning roller 31 is installed, the effect of suspending the toner particles in the carrier liquid can be enhanced. As a cleaning liquid, a liquid capable of being used as a carrier liquid of a liquid developer can be used generally and it may include toner particles. Toner particles included in the cleaning liquid are not adhered to the intermediate transfer member 6, so that they can be removed easily by the toner particles removing roller 32.

Furthermore, the liquid developer and cleaning liquid removed by the intermediate transfer member cleaning apparatus 30 and latent image carrier cleaning apparatus 20 can be reused again as a liquid developer and a cleaning liquid. Concretely, although described in detail in the fourth embodiment which will be described later, by using the similar method, the liquid developer and cleaning liquid removed can be reused.

The carrier liquid to be used as a cleaning liquid may be the same as or different from the carrier liquid of the liquid developer in use, though from the viewpoint of reuse of the removed liquid developer, it is preferably the same liquid. Further, the cleaning liquid is preferably a nonvolatile liquid. As a nonvolatile liquid, for example, silicon oil, mineral oil, and paraffin oil may be cited.

There are particularly no restrictions on the cleaning liquid supply method and for example, it is possible to install a cleaning liquid application roller so as to make contact with the preliminary cleaning roller 31, to immerse a part of the cleaning liquid application roller into the cleaning liquid stored in the cleaning liquid tank, thereby to supply the cleaning liquid or to supply the cleaning liquid directly to the contact portion between the preliminary cleaning roller 31 and the intermediate transfer member 6 through a tube using a pump.

The toner particles removing roller 32 removes toner particles by electrostatic force which are scraped from the surface of the intermediate transfer member 6 by the preliminary cleaning roller 31 and are suspended in the carrier liquid. To the toner particles removing roller 32, a voltage with reverse polarity to toner particles is impressed by a power source 34 to give a potential difference from the intermediate transfer member 6. By electrophoresis due to the potential difference, toner particles are moved to and removed by the toner particles removing roller 32 from the intermediate transfer member 6. To simplify the constitution, in place of the toner particles removing roller 32, a laminar toner particles removing element can be installed. There are no special restrictions on the material, though when the surface is composed of a conductive member, a current flows easily, so that from the viewpoint of safety, at least the surface is preferably composed of a member with a volume resistivity of 10,000 Ω·m or higher. For example, a metallic core covered with resin having a volume resistivity of 10,000 Ω·m or higher can be used. Further, in place of the toner particles removing roller 32, an alumite-treated aluminum roller can also be used effectively if the core surface composed of metallic aluminum or aluminum alloy is treated with alumite and the volume resistivity near its surface is increased to the level of over 10,000 Ω·m.

The toner particles removing roller 32 removes toner particles by the electrostatic force like this, though when it is tried to remove toner particles only by the toner particle removing roller 32 without installing the preliminary cleaning roller 31, the toner particles removing rate is about 50% at most. On the other hand, in a constitution that toner particles are scraped by the preliminary cleaning roller 31 and then instead of the toner particles removing roller 32, toner is removed by a general cleaning blade, toner particles pass through the cleaning blade, so that toner particles cannot be removed sufficiently likewise. The inventor found that the preliminary cleaning roller 31 for scraping toner particles on the surface and suspending them in the carrier liquid, the toner particles removing roller 32 for removing the suspended toner particles by the electrostatic force, and the sections for removing the carrier liquid are combined in this order, thus an extremely high cleaning performance is obtained, and even if the surfaces of the latent image carrier 1 and intermediate transfer member 6 enter the rough state due to use over a long period of time, the surfaces can be cleaned sufficiently. Therefore, even if the surface of a member (the intermediate transfer member in this case) to be cleaned is in the rough state, a cleaning apparatus capable of sufficiently removing toner particles can be provided.

As mentioned above, the toner particles removing roller 32 removes toner particles in the liquid developer by the electrophoresis due to the potential difference between the intermediate transfer member 6 and itself, though when the amount of the liquid component in the liquid developer in the area where the toner particles removing roller 32 removes toner particles is little, the movement of toner particles due to the electrophoresis becomes difficult and the toner particles removing rate is lowered. Therefore, it is preferable to install an additional cleaning liquid supply mechanism for supplying the cleaning liquid into the area where the toner particles removing roller 32 removes toner particles and prevent the amount of liquid component from lowering.

Here, when the mechanism for supplying a cleaning liquid to the preliminary cleaning roller 31 is installed, it is particularly effective to arrange the toner particles removing roller 32 so as to remove toner particles at a lower position in the gravity direction than the contact portion between the preliminary cleaning roller 31 and the intermediate transfer member 6. By such arrangement, the cleaning liquid supplied to the preliminary cleaning roller 31 is supplied into the area where the toner particles removing roller 32 removes toner particles, so that removal of toner particles by the toner particles removing roller 32 can be made sure. Further, compared with the case that an exclusive member for supplying the cleaning liquid to the toner particles removing roller 32, the number of parts can be reduced and the use amount of cleaning liquid can be reduced.

Furthermore, the inventor, as a result of diligent examination, found that when the mass per unit area of the liquid component in the area where the toner particles removing roller 32 removes toner particles is between 1 $g/m^2$ and 50 $g/m^2$, toner particles can be removed particularly efficiently. Furthermore, when it is between 2 $g/m^2$ and 10 $g/m^2$, the removing efficiency is preferably high particularly. Here, the mass per unit area of the liquid component is referred to as the sum of the mass per unit area of the carrier liquid in the liquid developer remaining on the surface of the intermediate transfer member 6 and the mass per unit area of the liquid component included in the cleaning liquid similarly remaining on the surface of the intermediate transfer member 6. When the mass per unit area of the liquid component is between 1 $g/m^2$ and 50 $g/m^2$, the movement of toner particles due to the electrophoresis is particularly efficient, thus it may be considered that the removing efficiency of toner particles by the toner particles removing roller 32 becomes high particularly. The mass per unit area of the liquid component can be adjusted by increasing or decreasing the supplied amount of the cleaning liquid supplied to the preliminary cleaning roller 31.

Toner particles included in the liquid developer can be removed by combination of the preliminary cleaning roller 31 and toner particles removing roller 32, though it is difficult to sufficiently remove the carrier liquid by such a combination of the two means. Particularly, when the cleaning liquid is supplied to remove toner particles, it is necessary to sufficiently remove the supplied cleaning liquid. When the carrier liquid and cleaning liquid are removed insufficiently, an effect such as bleeding is produced on an image to be formed next. Therefore, in the cleaning apparatus relating to the present invention, in addition to the preliminary cleaning roller 31 and toner particles removing roller 32, the blade 33 which is a carrier liquid removing member is installed and removes the remaining carrier liquid and cleaning liquid. In place of the carrier liquid removing blade 33, a sponge roller which is known conventionally can be used. There are no particular restrictions on the material of the cleaning blade and in addition to urethane rubber, silicon rubber, and fluororubber, various plastics and metals can be used. Also for the sponge roller, a material used generally, for example, polyurethane foam such as moltplain and color foam can be used.

As mentioned above, by the cleaning apparatus having three stages of cleaning means such as the preliminary cleaning member for sliding and rubbing the surface of the image carrier and suspending the toner particles adhered to the surface of the image carrier in the carrier liquid, the toner particles removing member for removing the suspended toner particles by the electrostatic force, and the carrier liquid removing member for removing the remaining carrier liquid, the liquid developer can be removed sufficiently.

The liquid developer to be used has main components of an insulating carrier liquid and toner for developing an electrostatic latent image. Any carrier liquid, if it is generally used for an electrophotographic developer, is not restricted particularly and a nonvolatile liquid is preferable particularly. As a nonvolatile liquid, for example, silicon oil, mineral oil, and paraffin oil may be cited.

Toner including a toner bonding resin and a coloring pigment or dye and any toner, if generally used for an electrophotographic developer, is not restricted particularly. As a toner bonding resin, for example, thermoplastic resin such as polystyrene resin, styrene-acrylic resin, acrylic resin, polyester resin, epoxy resin, polyamide resin, polyimide resin, and polyurethane resin can be used. Further, a mixture of some of the aforementioned resins can be used. Further, general coloring pigments or dyes in the market can be used. For example, as a pigment, carbon black, blood red, titanium oxide, silica, phthalocyanine blue, phthalocyanine green, sky blue, benzidine yellow, and lake red D can be used. As a dye, solvent red 27 and acid blue 9 can be used.

With respect to the preparation method for a liquid developer, the liquid developer can be prepared on the basis of the technical method used generally. For example, a toner bonding resin and a pigment are fused, mixed, and uniformly diffused at a predetermined compounding ratio using a pressure kneader or a roller mill, and the obtained diffused article is ground finely, for example, by a jet mill. The obtained fine powder is classified, for example, by an air sorter, thus colored toner with a desired particle diameter is obtained. Then, the obtained toner is mixed with an insulating carrier liquid at a predetermined compounding ratio. This mixture is diffused uniformly by a diffusion means such as a ball mill, thus a liquid developer can be obtained. There are no special restrictions on the density and viscosity of the liquid developer, though when the density is 10% by mass to 50% by mass and the viscosity at 25° C. is 0.01 Pa·s to 100 Pa·s, the liquid developer is effective. Here, the density of the liquid developer is calculated by the following formula.

Density of liquid developer[% by mass]=(mass of toner particles[g]/(mass of toner particles[g]+mass of carrier liquid[g]))×100

In this embodiment, the cleaning apparatus of the present invention is used not only as the intermediate transfer member cleaning apparatus 30 which is explained mainly so far but also as the latent image carrier cleaning apparatus 20. The latent image carrier cleaning apparatus 20 includes a preliminary cleaning roller 21 as a preliminary cleaning member, a toner particles removing roller 22 as a toner particles removing member, a carrier liquid removing blade 23 as a carrier liquid removing member, and a power source 24 for impressing a bias voltage to the toner particles removing roller 22. Although the objects to be cleaned are different, the constitution and effect as a cleaning apparatus are the same as those when it is used as the intermediate transfer member cleaning apparatus 30. Namely, by installation of the three stages of cleaning means such as the preliminary cleaning member for sliding and rubbing the surface of the image carrier and suspending the toner particles adhered to the surface of the image carrier in the carrier liquid, the toner particles removing member for removing the suspended toner particles by the electrostatic force, and the carrier liquid removing member for removing the remaining carrier liquid, the liquid developer remaining on the surface of the latent image carrier can be removed sufficiently.

Figure 2:
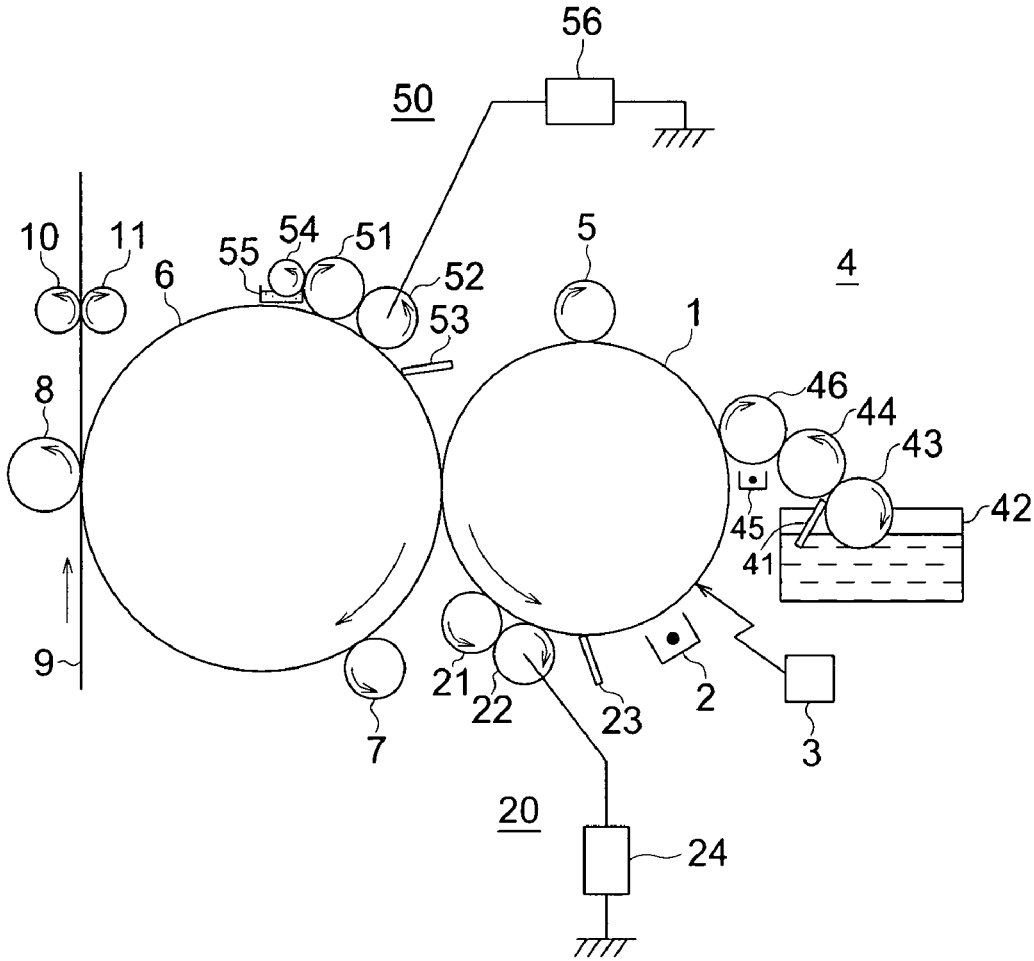
FIG. 2 is a schematic block diagram of an image forming apparatus having a cleaning apparatus of the second embodiment of the present invention.

FIG. 2 is a drawing showing the schematic constitution of the image forming apparatus using the cleaning apparatus of the second embodiment of the present invention as an intermediate transfer member cleaning apparatus 50.

The intermediate transfer member cleaning apparatus 50 includes the three stages of cleaning means such as a sponge roller 51 as a preliminary cleaning member for sliding and rubbing the surface of the intermediate transfer member 6 and suspending the toner particles adhered to the surface of the intermediate transfer member 6 in the carrier liquid, an alumite-treated aluminum roller 52 as a toner particles removing member for removing the suspended toner particles by the electrostatic force, and a rubber blade 53 as a carrier liquid removing member for removing the remaining carrier liquid.

A cleaning liquid application roller 54 is installed so as to make contact with the sponge roller 51, and a part of the cleaning liquid application roller 54 is immersed in the cleaning liquid stored in a cleaning liquid tank 55, thus the cleaning liquid is supplied to the sponge roller 51. The cleaning liquid application roller 54 and cleaning liquid tank 55 compose the cleaning liquid supply mechanism of the present invention. Therefore, the sponge roller 51 can enhance more the effect of suspending the toner particles in the carrier liquid. Further, the alumite-treated aluminum roller 52 is connected to a power source 56 at a lower position in the gravity direction than the contact portion between the sponge roller 51 and the intermediate transfer member 6 and is arranged so as to remove toner particles by electrostatic force. Further, the cleaning liquid supplied to the sponge roller 51 is also supplied to the area where the alumite-treated aluminum roller 52 removes toner particles, so that a constitution capable of preventing the toner particles removing efficiency from lowering due to lowering in the amount of liquid component is used.

Furthermore, a constitution of removing the toner particles adhered to the surface of the sponge roller 51 by the electrostatic force by the alumite-treated aluminum roller 52 is used. Therefore, toner particles are not accumulated on the surface of the sponge roller 51 and the original function of the preliminary cleaning member for scraping out the toner particles adhered to the surface of the intermediate transfer member 6 can be maintained for a long period of time.

Further, for the latent image carrier cleaning apparatus 20, the same one as the latent image carrier cleaning apparatus 20 used by the apparatus shown in FIG. 1 is used.

Further, reusing again the liquid developer and cleaning liquid removed by the intermediate transfer member cleaning apparatus 50 and latent image carrier cleaning apparatus 20 as a liquid developer and a cleaning liquid, similarly to the first embodiment, can be executed using the method explained in detail in the fourth embodiment which will be described later.

Figure 3:
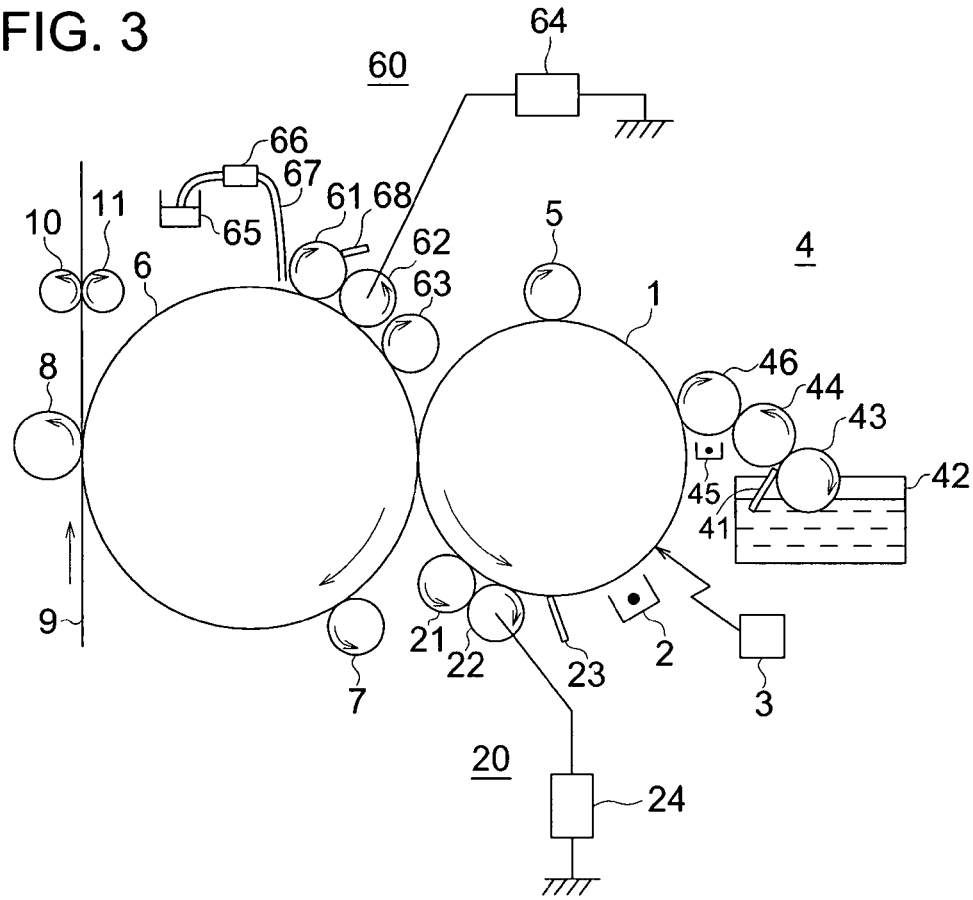
FIG. 3 is a schematic block diagram of an image forming apparatus having a cleaning apparatus of the third embodiment of the present invention.

FIG. 3 is a drawing showing the schematic constitution of the image forming apparatus using the cleaning apparatus of the third embodiment of the present invention as an intermediate transfer member cleaning apparatus 60.

The intermediate transfer member cleaning apparatus 60 includes a moltplain roller 61 as a preliminary cleaning member, a PET coated roller 62 as a toner particles removing member, a sponge roller 63 as a carrier liquid removing member, and a power source 64 for impressing a bias voltage to the PET coated roller 62, and by the three stages of cleaning means, the liquid developer remaining on the intermediate transfer member 6 is removed.

In this embodiment, the cleaning liquid stored in a cleaning liquid tank 65 is supplied to the moltplain roller 61 via a supply tube 67 by a supply pump 66, so that the moltplain roller 61 enhances more the effect of suspending the toner particles in the carrier liquid. Further, the PET coated roller 62 is arranged so as to remove toner particles at a lower position in the gravity direction than the contact portion between the moltplain roller 61 and the intermediate transfer member 6, and the cleaning liquid supplied to the moltplain roller 61 is also supplied into the area where the PET coated roller 62 removes toner particles, so that a constitution capable of preventing the toner particles removing efficiency from lowering due to lowering in the amount of liquid component is used. The cleaning liquid tank 65, supply pump 66, and supply tube 67 compose the mechanism of the present invention for supplying the cleaning liquid into the area for removing toner particles.

Further, for the latent image carrier cleaning apparatus 20, the same one as the latent image carrier cleaning apparatus 20 used by the apparatus shown in FIG. 1 is used.

Further, reusing again the liquid developer and cleaning liquid removed by the intermediate transfer member cleaning apparatus 60 and latent image carrier cleaning apparatus 20 as a liquid developer and a cleaning liquid, similarly to the first embodiment, can be executed using the method explained in detail in the fourth embodiment which will be described later.

Figure 6:
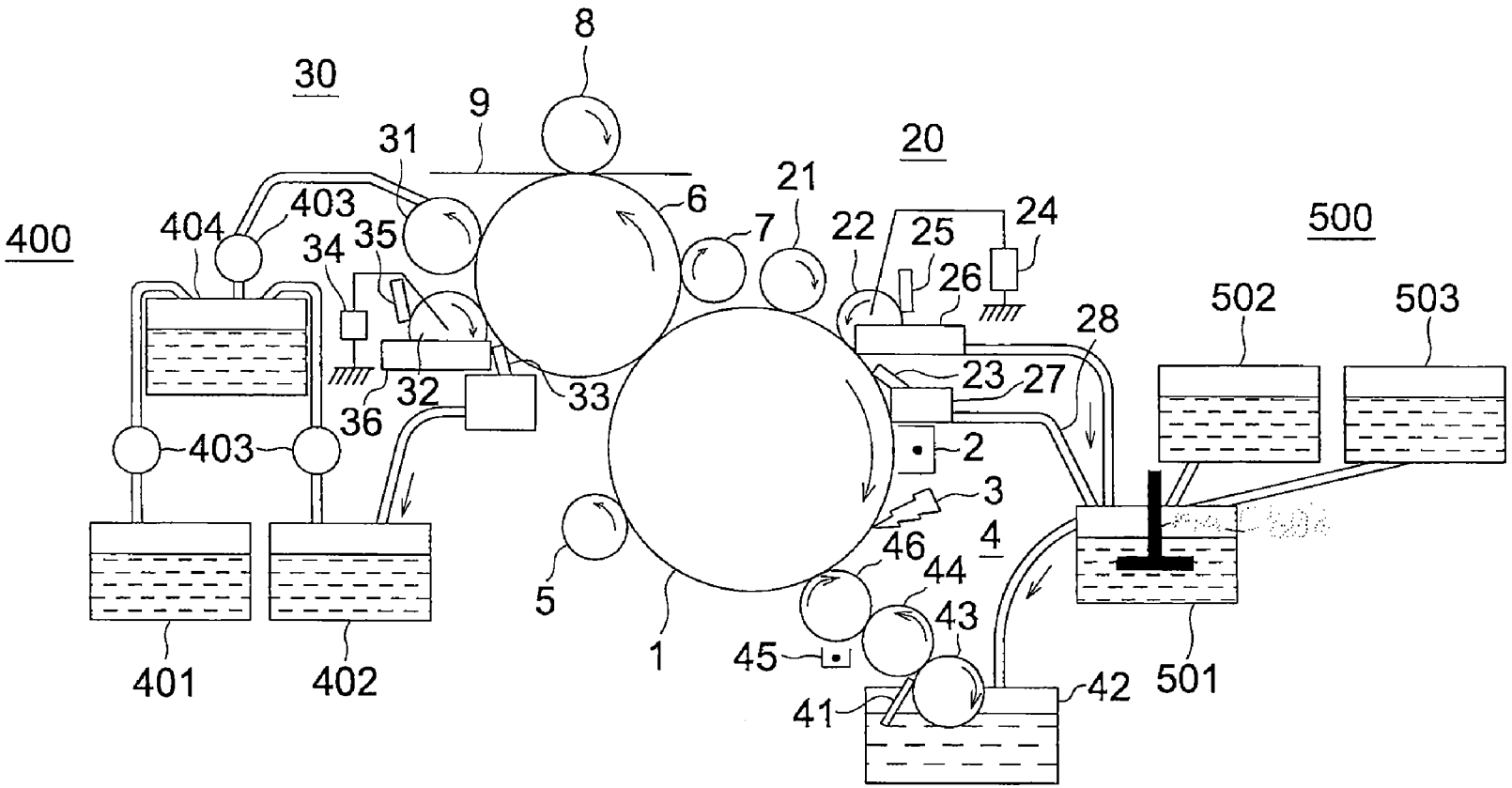
FIG. 6 is a schematic block diagram of an image forming apparatus having a cleaning apparatus of the fourth embodiment of the present invention.

FIG. 6 shows the fourth embodiment including, adding to the first embodiment, a cleaning liquid supply and reuse device 400 for reusing the carrier liquid and cleaning liquid removed by the intermediate transfer member cleaning apparatus 30 and a liquid developer supply and reuse device 500 capable of reusing the liquid developer removed by the latent image carrier cleaning apparatus 20.

The cleaning liquid supply and reuse device 400 includes three tanks such as a cleaning liquid tank 401 for storing the cleaning liquid, a waste liquid tank 402 for storing the carrier liquid and cleaning liquid removed by the blade 33 of the intermediate transfer member cleaning apparatus 30, and a mixing tank 404 for pumping liquids of the cleaning liquid tank 401 and waste liquid tank 402 by a pump 403 and mixing them. The mixed liquid of the carrier liquid and cleaning liquid of the mixing tank is supplied to the preliminary cleaning roller 31 by the pump 403. Further, the mixed liquid of the carrier liquid and cleaning liquid removed by the blade 33 is filtered by the waste liquid tank 402 and then is sent to the mixing tank 404. Further, the toner removed by the toner particles removing roller 32 is stored in a toner particles removing tank 36 after being scrubbed off by a toner particles removing blade 35 which contacts with the surface of the toner particles removing roller 32. When the amount of removed toner in the toner particles removing tank 36 reaches a predetermined amount, the toner particles removing tank 36 is replaced with a new toner particles removing tank 36. The carrier liquid and cleaning liquid removed from the intermediate transfer member cleaning apparatus 30 in this way are reused by the cleaning liquid supply and reuse device 400, thus a cleaning apparatus and an image forming apparatus which are more economical and long-lived can be provided.

Further, the liquid developer supply and reuse device 500 reuses the toner and carrier liquid of the liquid developer removed by the latent image carrier cleaning apparatus 20. The toner removed by the toner particles removing roller 22 is stored in a toner particles removing tank 26 after being scrubbed off by a toner removing blade 25 which contacts with the surface of the toner particles removing roller 22. The toner particles removing blade 25, toner particles removing tank 26 and the toner particles removing blade 35, toner particles removing tank 36 respectively compose the toner particles collecting mechanism of the present invention. The toner removed by the toner particles removing roller 22 is supplied to an agitation detection tank 501. The carrier liquid removed by the blade 23 is supplied to the agitation detection tank 501 via a carrier liquid collection tank 27 and a carrier liquid supply tube 28. The carrier liquid collection tank 27 and carrier liquid supply tube 28 compose the carrier liquid collecting mechanism of the present invention. The agitation detection tank 501 mixes and agitates both liquids supplied from a concentrated liquid tank 502 storing a concentrated liquid with a high toner density and a carrier liquid tank 503 storing a carrier liquid with the removed toner and carrier liquid by detecting the density so as to obtain a predetermined toner density. The liquid developer set at the predetermined density by the agitation detection tank 501 is supplied to a developer tank 42. The toner and carrier liquid removed from the latent image carrier cleaning apparatus 20 in this way are reused by the liquid developer supply and reuse device 500, thus a cleaning apparatus and an image forming apparatus which are more economical and long-lived can be provided. Further, the setting system for the blades 23, 33 and the toner particles removing blades 25, 35 may be the forward blade system in which the free end, which contacts with the roller, of the blade sits at upstream of the fixed end or may be the reverse blade system in which the free end sits at downstream of the fixed end.

According to this embodiment of the present invention, by installation of the three stages of cleaning means such as the preliminary cleaning member for sliding and rubbing the surface of the latent image carrier which is an image carrier or of the intermediate transfer member and for suspending the toner particles adhered to the surface of the image carrier in the carrier liquid, the toner particles removing member for removing the suspended toner particles by the electrostatic force, and the carrier liquid removing member for removing the remaining carrier liquid, a cleaning apparatus for sufficiently removing the liquid developer remaining on the surface of the image carrier can be provided. Further, by installation of the concerned cleaning apparatus, an image forming apparatus capable of forming images of stable quality can be provided.

EXAMPLES

Example 1

The image forming apparatus shown in FIG. 2 is used. The cleaning apparatus of the second embodiment of the present invention is used as an intermediate transfer member cleaning apparatus 50. The latent image carrier 1 is composed of an aluminum drum with a diameter of 210 mm having a formed organic photosensitive film (film thickness of 35 μm) and the rotation peripheral speed is set at 350 mm/s. The main charger 2 uses a scorotron charger and the surface potential of the latent image carrier 1 is controlled to −450 V. The exposure unit 3 is set so as to control the surface potential of the latent image carrier 1 to −100 V when the image portion is exposed by a semiconductor laser. As a liquid developer, to a carrier liquid (silicon oil by Shinetsu Silicon, Ltd.), black toner inside the color copier C350 by Konica Minolta Business Technologies, Ltd. which is ground to an average particle diameter of 3 μm is added. Furthermore, a dispersant (SOLSPERSE 13940 by Avecia Inkjet Ltd.) of 10% by mass of the toner amount is added. Further, the density of the obtained liquid developer is 20% by mass, and the viscosity at 25° C. is 0.03 Pa·s, and the charge amount of toner is −100 μC/g.

The intermediate transfer member 6 is of diameter of 100 mm and composed of a silicon rubber (3 mm) substrate whose surface is coated with urethane at a thickness of 1 mm. To the intermediate transfer member 6, a voltage of +400 V is impressed. Further, as a latent image carrier cleaning blade 23, a blade made of silicon rubber with a thickness of 3 mm is used. The latent image carrier cleaning blade 23, during the cleaning operation, is in contact with the latent image carrier 1 at an angle of 20 degrees from the tangential line in the counter direction. The pressurizing force is 0.341 N/cm.

The conditions of the sponge roller 51 are as follows.

Diameter: 26 mm

Material: Urethane sponge roller, density 30 kg/m$^3$

Rotation peripheral speed: 450 mm/s (in the counter direction to the intermediate transfer member 6)

Supplied liquid: Same as the carrier liquid used in the liquid developer

The conditions of the alumite-treated aluminum roller 52 are as follows.

Diameter: 26 mm

Material: Aluminum roller whose surface is treated with alumite

Rotation peripheral speed: 350 mm/s (in the with direction to the sponge roller 51)

Bias voltage: +650 V

The conditions of the rubber blade 53 are as follows.

Material, thickness: Silicon rubber, thickness 3 mm

Contact angle: 20 degrees from the tangential line of the intermediate transfer member 6 (in the direction opposite to the movement of the intermediate transfer member 6)

Pressurizing force: 0.341 N/cm

The cleaning liquid application roller 54 is installed so as to make contact with the sponge roller 51, and a part of the cleaning liquid application roller 54 is immersed in the cleaning liquid stored in the cleaning liquid tank 55, thus the cleaning liquid is supplied to the sponge roller 51. The cleaning liquid is the same liquid as the carrier liquid of the liquid developer used. The alumite-treated aluminum roller 52 is arranged so as to remove toner particles at a position in the gravity direction below the contact portion between the sponge roller 51 and the intermediate transfer member 6, so that the cleaning liquid supplied to the sponge roller 51 is also supplied into the area where the alumite-treated aluminum roller 52 removes toner particles. The supply amount of cleaning liquid is adjusted so as to control the mass per unit area of the liquid component on the surface of the intermediate transfer member 6 in the concerned area to 5 g/m$^2$.

Further, a constitution that a potential difference is given between the alumite-treated aluminum roller 52 and the sponge roller 51 and that the alumite-treated aluminum roller 52 removes toner particles adhered to the surface of the sponge roller 51 by the electrostatic force is used.

Under this condition, the durability test is carried out based on a pattern of outputting five successive charts of A4 size with a black and white ratio (B/W) of 5% and subsequently stopping the output, and the cleaning performance is evaluated. The cleaning performance is obtained from the mass A of the liquid developer on the surface of the intermediate transfer member 6 after transferred to the image receiving material 9 and the mass B of the liquid developer remaining on the surface of the intermediate transfer member 6 after cleaning by the intermediate transfer member cleaning apparatus 50 using the formula indicated below. When the cleaning performance is reduced to less than 70%, it influences an image to be formed next as a gray background image, thus resulting in an actual problem.

$$\text{Cleaning performance}[\%]=((A-B)/A)\times 100$$

The cleaning performance was 98% at the start of testing and at the point of outputting 10,000 copies. At this time, Rz of the intermediate transfer member 6 was 2.5 μm at the start of testing and 2.8 μm at the point of outputting 10,000 copies. Further tests were carried out, resulting in increasing to 4.5 μm at the point of outputting 100,000 copies, but while the cleaning performance decreased to 82%, a sufficient performance was still maintained.

Comparative Example 1

A cleaning apparatus having a constitution that the sponge roller 51 as a preliminary cleaning member was removed from the intermediate transfer member cleaning apparatus 50 of Example 1 was used and copies were output under the same conditions as those of Example 1. The cleaning performance, at the start of testing, showed an excellent value of 75%, but at the point of outputting 10,000 copies, decreased to 65%, which is a problematic level in practice. Rz of the intermediate transfer member 6 was 2.5 μm at the start of testing and 2.7 μm at the point of outputting 10,000 copies.

Comparative Example 2

A cleaning apparatus having a constitution that the alumite-treated aluminum roller 52 as a toner particles removing member was removed from the intermediate transfer member cleaning apparatus 50 of Example 1 was used and copies were output under the same conditions as those of Example 1. The cleaning performance, at the start of testing, was already 65% which was an insufficient level. Rz of the intermediate transfer member 6 at this time was 2.5 μm.

The results of Example 1 and Comparative Examples 1 and 2 are summarized in Table 1. The cleaning apparatus of Example 1 has a high cleaning performance at the start of testing and even after Rz of the intermediate transfer member is increased due to repetition of image output, it can be confirmed that the satisfactory cleaning performance can be maintained.

TABLE 1

| | Cleaning performance (%) | | |
|---|---|---|---|
| | At the start of testing | After outputting 10,000 copies | After outputting 100,000 copies |
| Example 1 | 98 | 98 | 82 |
| Comparative Example 1 | 75 | 65 | — |
| Comparative Example 2 | 65 | — | — |

Examples 2 to 5

The image forming apparatus shown in FIG. 3 is used. The cleaning apparatus of the third embodiment of the present invention is used as an intermediate transfer member cleaning apparatus 60. As a liquid developer, the same one as that of Example 1 is used.

The conditions of the moltplain roller 61 are as follows.

Diameter: 26 mm

Material: Moltplain, density 30 kg/m$^3$

Rotation peripheral speed: 450 mm/s (in the counter direction to the intermediate transfer member 6)

Supplied liquid: Same as the carrier liquid used in the liquid developer

The conditions of the PET coated roller 62 are as follows.

Diameter: 26 mm

Material: A PET film is adhered to a metallic core.

Rotation peripheral speed: 350 mm/s (in the with direction to the intermediate transfer member 6)

Bias voltage: +650 V

The conditions of the sponge roller 63 are as follows.

Diameter: 26 mm

Material: Urethane sponge roller, density 30 kg/m$^3$

Rotation peripheral speed: 450 mm/s (in the counter direction to the intermediate transfer member 6)

The cleaning liquid stored in the cleaning liquid tank 65 is supplied to the moltplain roller 61 via the supply tube 67 by the supply pump 66. The cleaning liquid is the same liquid as the carrier liquid of the liquid developer used. The PET coated roller 62 is arranged so as to remove toner particles at a position in the gravity direction below the contact portion between the moltplain roller 61 and the intermediate transfer member 6, so that the cleaning liquid supplied to the moltplain roller 61 is also supplied into the area where the PET coated roller 62 removes toner particles. The supply amount of cleaning liquid is changed, and the mass per unit area of the liquid component on the surface of the intermediate transfer member 6 in the concerned area is adjusted in the four ways of 0.8 g/m$^2$, 1 g/m$^2$, 10 g/m$^2$, and 12 g/m$^2$, and copies are output under the respective conditions. The other conditions are the same as those of Example 1.

A constitution that toner particles adhered to the moltplain roller 61 are removed by a urethane rubber blade 68 which is the additional toner particles removing member of the present invention is used. The moltplain roller 61 and PET coated roller 62 are not in contact with each other.

The results when the cleaning performance is evaluated under the respective conditions are shown in Table 2.

TABLE 2

| | Liquid component amount (g/m$^2$) | Cleaning performance (%) At the start of testing | After outputting 10,000 copies | After outputting 100,000 copies |
|---|---|---|---|---|
| Example 2 | 0.8 | 95 | 94 | 72 |
| Example 3 | 1 | 96 | 98 | 80 |
| Example 4 | 10 | 98 | 98 | 82 |
| Example 5 | 12 | 96 | 96 | 75 |

Under the respective conditions, at the start of testing, the cleaning apparatus has a very high cleaning performance of 95% or higher and even after outputting 10,000 copies, the cleaning performance is little changed. Furthermore, even at the point of outputting 100,000 copies, the cleaning performance is kept at the level of no practical problem. When the mass per unit area of the liquid component is 1 g/m$^2$ (Example 3) and 10 g/m$^2$ (Example 4) of all the examples, it can be confirmed that the cleaning apparatus can keep a particularly high level. If the mass per unit area of the liquid component is more than 50 g/m$^2$, the cleaning liquid supply mechanism must be more large-sized. Consequently, it becomes more costly.

What is claimed is:

1. A cleaning apparatus for an image forming apparatus which forms an image with liquid developer containing toner particles and carrier liquid, the cleaning apparatus comprising:

a preliminary cleaning member which contacts with a surface of an image carrier to suspend the toner particles in the carrier liquid on the image carrier;

a toner particles removing member which is provided downstream of the preliminary cleaning member in a moving direction of the image carrier and removes the suspended toner particles in the carrier liquid by an electrostatic force; and a carrier liquid removing member which is provided downstream of the toner particles removing member in the moving direction of the image carrier and removes the carrier liquid.

2. The cleaning apparatus of claim 1, wherein at least a portion of the preliminary cleaning member which contacts with the image carrier is spongy or brush-shaped.

3. The cleaning apparatus of claim 1, wherein the preliminary cleaning member includes a rotatable roller shaped member.

4. The cleaning apparatus of claim 1, further comprising:

a cleaning liquid supply mechanism which is adapted to apply cleaning liquid to the preliminary cleaning member.

5. The cleaning apparatus of claim 4, wherein the cleaning liquid supply mechanism includes:

a cleaning liquid tank; and a cleaning liquid application roller which applies the cleaning liquid stored in the cleaning liquid tank to the preliminary cleaning member.

6. The cleaning apparatus of claim 4, wherein the cleaning liquid supply mechanism includes:

a cleaning liquid tank; and a supply tube which applies the cleaning liquid stored in the cleaning liquid tank to the preliminary cleaning member.

7. The cleaning apparatus of claim 1, further comprising:

an additional toner particles removing member which removes the toner particles staying on the preliminary cleaning member.

8. The cleaning apparatus of claim 1, wherein the toner particles removing member includes a rotatable roller shaped member.

9. The cleaning apparatus of claim 1, wherein the toner particles removing member removes the toner particles staying on the preliminary cleaning member by an electrostatic force.

10. The cleaning apparatus of claim 9, wherein the preliminary cleaning member includes a rotatable roller shaped member, the toner particles removing member includes a rotatable roller shaped member which contacts with the preliminary cleaning member, and a contact region of the both roller shaped members moves in a same direction at a contact position therebetween.

11. The cleaning apparatus of claim 1, further comprising:

a mechanism which is adapted to supply cleaning liquid to a region where the toner particles removing member removes the toner particles.

12. The cleaning apparatus of claim 1, wherein the toner particles removing member removes the toner particles at a lower position in a gravity direction than a contact position of the preliminary cleaning member and the image carrier.

13. The cleaning apparatus of claim 1, wherein mass of a liquid component per unit area in the region where the toner particles removing member removes the toner particles is not less than 1 g/m2 and not more than 50 g/m2.

14. The cleaning apparatus of claim 1, the carrier liquid removing member includes a blade.

15. The cleaning apparatus of claim 1, wherein the carrier liquid removing member includes a sponge roller.

16. The cleaning apparatus of claim 1, further comprising:

a toner particles collecting mechanism which is adapted to collect the toner particles removed by the toner particles removing member.

17. The cleaning apparatus of claim 16, wherein the toner particles removing member includes a roller, and the toner particles collecting mechanism includes a blade which contacts with the roller.

18. The cleaning apparatus of claim 1, further comprising:

a carrier liquid collecting mechanism which is adapted to collect the carrier liquid removed by the carrier liquid removing member.

19. An image forming apparatus, comprising:

an image carrier;

an image forming mechanism which is adapted to form an electrostatic latent image on the image carrier;

a development mechanism which is adapted to develop the electrostatic latent image formed on the image carrier into a toner image with a liquid developer containing toner particles and a carrier liquid;

a transfer mechanism which is adapted to transfer the toner image formed on the image carrier onto an image receiving material;

a cleaning apparatus for cleaning the liquid developer remaining on the image carrier after the transferring by the transfer mechanism, the cleaning apparatus including:

a preliminary cleaning member which contacts a surface of the image carrier to suspend the toner particles in the carrier liquid on the image carrier;

a toner particles removing member, which is provided downstream of the preliminary cleaning member in a moving direction of the image carrier, and removes the suspended toner particles in the carrier liquid by an electrostatic force; and a carrier liquid removing member, which is provided downstream of the toner particles removing member in the moving direction of the image carrier, and which removes the carrier liquid.

20. An image forming apparatus, comprising:

an image carrier;

an image forming mechanism which is adapted to form an electrostatic latent image on the image carrier;

a development mechanism which is adapted to develop the electrostatic latent image formed on the image carrier into a toner image with a liquid developer containing toner particles and a carrier liquid;

an intermediate transfer member;

a primary transfer mechanism, which is adapted to transfer the toner image formed on the image carrier onto the intermediate transfer member;

a secondary transfer mechanism, which is adapted to transfer the toner image transferred on the intermediate transfer member onto an image receiving material;

a first cleaning apparatus for cleaning the liquid developer remaining on the intermediate transfer member after the transferring by the secondary transfer mechanism;

the first cleaning apparatus comprising:

a first preliminary cleaning member, which contacts a surface of the intermediate transfer member to suspend the toner particles in the carrier liquid on the intermediate transfer member;

a first toner particles removing member, which is provided downstream of the first preliminary cleaning member in a moving direction of the intermediate transfer member, and removes the suspended toner particles in the carrier liquid by an electrostatic force; and a first carrier liquid removing member, which is provided downstream of the first toner particles removing member in the moving direction of the intermediate transfer member, and removes the carrier liquid.

21. The image forming apparatus of claim 20, further comprising:

a second cleaning apparatus for cleaning the liquid developer remaining on the image carrier after the transferring by the primary transfer mechanism, the second cleaning apparatus including:

a second preliminary cleaning member, which contacts a surface of the image carrier to suspend the toner particles in the carrier liquid on the image carrier;

a second toner particles removing member, which is provided downstream of the second preliminary cleaning member in a moving direction of the image carrier, and removes the suspended toner particles in the carrier liquid by an electrostatic force; and a second carrier liquid removing member, which is provided downstream of the second toner particles removing member in the moving direction of the image carrier, and removes the carrier liquid.

22. A cleaning method for an image forming apparatus, which forms an image by using a liquid developer containing toner particles and carrier liquid, the method comprising:

suspending the toner particles in the carrier liquid by making a preliminary cleaning member contact an image carrier;

removing the toner particles in the carrier liquid suspended by the preliminary cleaning member, by an electrostatic force; and removing the carrier liquid remaining on the image carrier after removing the toner particles.

* * * * *